US005651545A

United States Patent [19]

Nashif et al.

[11] Patent Number: 5,651,545

[45] Date of Patent: Jul. 29, 1997

[54] VIBRATION DAMPING DEVICE FOR STRINGED RACQUETS

[75] Inventors: Ahid D. Nashif, Cincinnati, Ohio; Gopichand Koganti, Sunnyvale, Calif.

[73] Assignee: Roush Anatrol, Inc., Sunnyvale, Calif.

[21] Appl. No.: 484,451

[22] Filed: Jun. 7, 1995

[51] Int. Cl.[6] ..... A03B 51/10

[52] U.S. Cl. ..... 473/520

[58] Field of Search ..... 273/73 R, 73 C, 273/73 D, 73 E, 73 G, 73 S, 29 R

[56] References Cited

U.S. PATENT DOCUMENTS

| | | | |
|---|---|---|---|
| 13,337 | 2/1855 | Coke . | |
| 3,874,666 | 4/1975 | Ross | 273/73 R |
| 3,941,380 | 3/1976 | Lacoste . | |
| 4,180,265 | 12/1979 | Staufer . | |
| 4,541,631 | 9/1985 | Sasse . | |
| 4,609,198 | 9/1986 | Tarr . | |
| 4,736,949 | 4/1988 | Muroi . | |
| 4,761,007 | 8/1988 | Boschian . | |
| 4,811,947 | 3/1989 | Takatsuka et al. . | |
| 4,909,509 | 3/1990 | Boschain . | |
| 4,927,143 | 5/1990 | Hillock | 273/73 D |
| 4,948,131 | 8/1990 | Nakanishi . | |
| 5,131,652 | 7/1992 | Peng . | |
| 5,141,228 | 8/1992 | Soong . | |
| 5,211,397 | 5/1993 | Davis et al. | 273/73 D |
| 5,242,724 | 9/1993 | You . | |
| 5,269,516 | 12/1993 | Janes . | |
| 5,282,618 | 2/1994 | Hong . | |
| 5,314,180 | 5/1994 | Yamagishi et al. . | |
| 5,322,280 | 6/1994 | Wu . | |
| 5,362,046 | 11/1994 | Sims . | |

*Primary Examiner*—William M. Pierce
*Attorney, Agent, or Firm*—Bliss McGlynn, P.C.

[57] ABSTRACT

A vibration damping device for stringed racquets including a viscoelastic member adapted to be mounted between strings of the racquet and at least one movable member carried on the viscoelastic member. The movable member is movable relative to the viscoelastic member in response to vibrations induced by an impact on the strings of the racquet such that the vibration damping device vibrates over the same frequency range but out of phase with the racquet to dampen vibrations in the racquet.

17 Claims, 3 Drawing Sheets

FIG 1
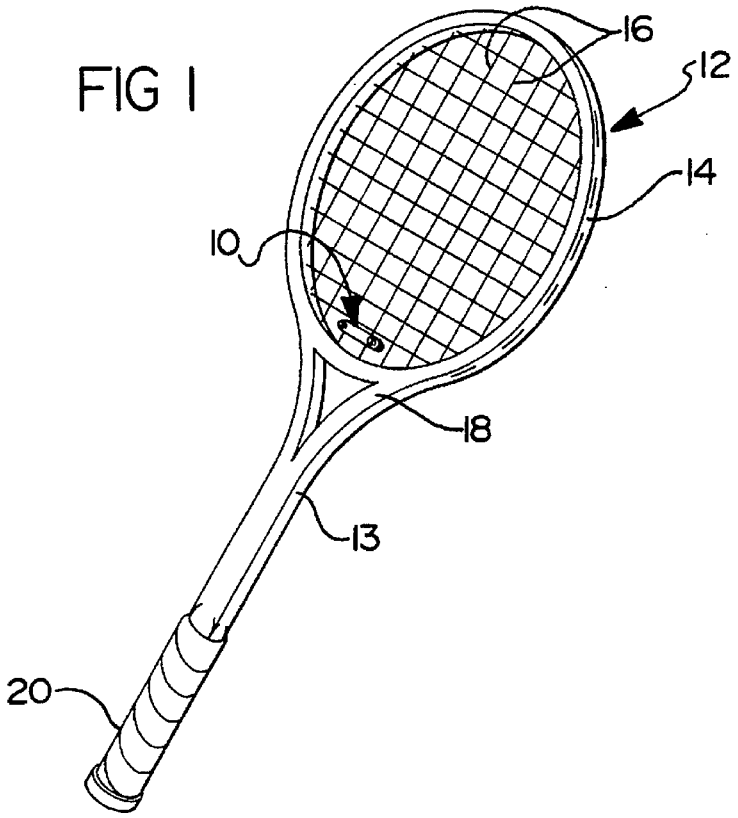
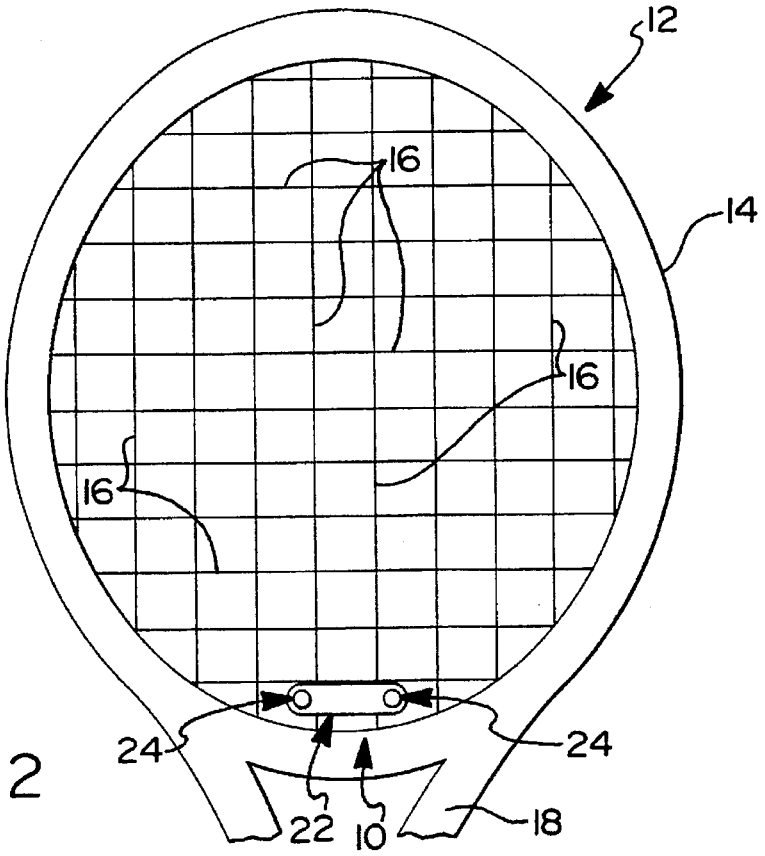
FIG 2

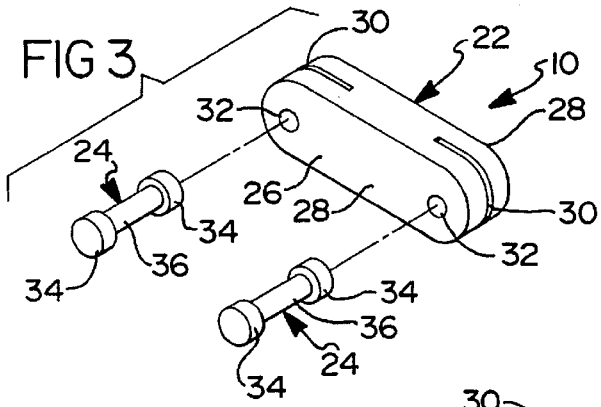
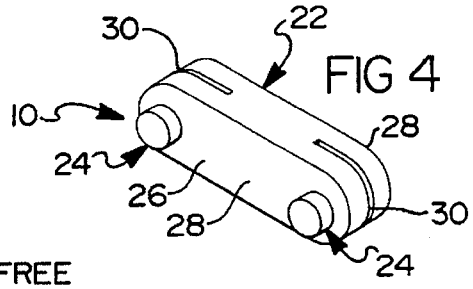
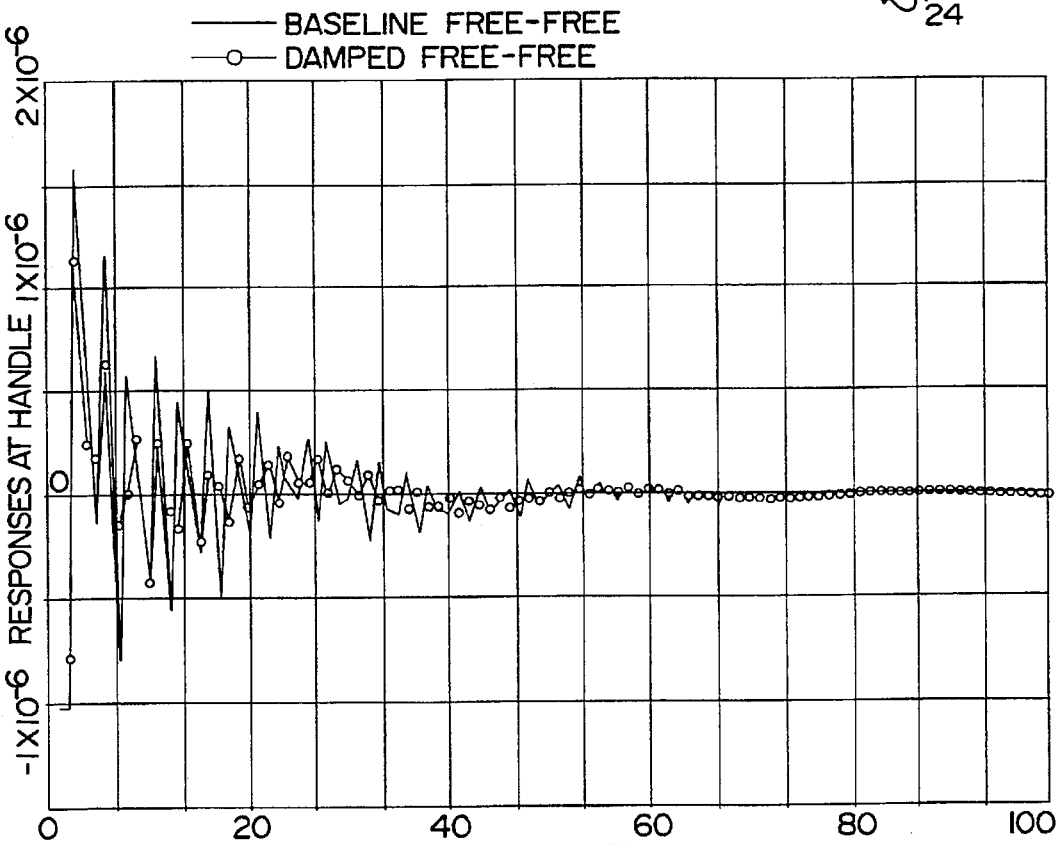
FIG 5

VIBRATION DAMPING DEVICE FOR STRINGED RACQUETS

BACKGROUND OF THE INVENTION

1. Field of the Invention

The present invention relates generally to vibration damping devices and, more specifically, to vibration damping devices for stringed racquets.

2. Description of the Related Art

The popularity of sports involving stringed racquets, such as tennis and racquet ball, continues at a strong pace. Better engineering, better materials, lighter, stronger racquets with larger heads and more power have improved the play of games with these racquets and thereby increased the enjoyment associated therewith. Although these racquets have worked well, they suffer from that disadvantage that despite improvements in other areas the unwanted vibratory phenomena generated upon an impact with a ball which is not dead center in the "sweet spot" of the racquet remains.

Lighter racquets have allowed players to swing harder at the ball. Larger racquet heads, while increasing the "sweet spot" on the stringed face thereof, have also increased the area outside the "sweet spot", providing increased opportunity for imperfect or offset contact with the ball.

Vibrations are introduced into the racquet due to the impact the ball creates on the strings of the racquet. At impact, the velocity of the ball transfers its energy into the strings and the strings, in turn, pass it onto the frame of the racquet. The sweet spot of the racquet is the point of minimum vibration. When the ball is hit perfectly, in the center of the sweet spot, the vibrations generated do not negatively affect the player and even give a distinctive, pleasant sound confirming the quality of the player's stroke.

On the other hand, when the ball is hit off center, this condition creates imbalanced forces and generates vibrations. Ideally, and in the absence of a damping medium, the vibrations would continue for an infinite time. Unfortunately, the human arm, which holds the racquet, is a very good damping medium and absorbs this energy. The energy absorbed by the human arm is dissipated in the form of pain and tiredness.

Vibration dampers/absorbers for stringed racquets are now commercially available. Commercial dampers have been implemented on the strings of the racquet to absorb the energy at the string frequencies. However, the strings vibrate at higher frequencies than the racquet itself and do not produce any physical motion in the racquet frame. Thus, commercial dampers presently available primarily help in reducing the noise generated in connection with an off center contact with the ball but contribute very little to the reduction of vibrations in the racquet frame which are ultimately damped by the human arm.

SUMMARY OF THE INVENTION

It is, therefore, one object of the present invention to provide a vibration damping device for a stringed racquet.

It is another object of the present invention to provide a vibration damping device for a stringed racquet which effectively cancels the vibration generated by unbalance forces due to an off center contact with a ball.

To achieve the foregoing objects, the present invention is a vibration damping device for stringed racquets including a viscoelastic member adapted to be mounted between strings of the racquet. The vibration damping device also includes at least one movable member carried on the viscoelastic member and movable relative to the viscoelastic member in response to vibrations induced by an impact on the strings of the racquet such that the vibration damping device vibrates over the same frequency range but out of phase with the racquet to damp vibrations in the racquet.

One advantage of the present invention is that a vibration damping device is provided for a stringed racquet which, the device itself, is a vibrating system. Another advantage of the present invention is that the vibration damping device vibrates at the same frequency as the racquet and in a plane normal to the frame of the racquet. Yet another advantage of the present invention is that the racquet and vibration damping device vibrate at the same frequency and in a phase opposite to each other to cancel out each other and the resultant responses in the racquet are reduced by a significant amount. A further advantage of the present invention is that the vibrations transmitted into the racquet frame are greatly reduced and the human arm tends to absorb much less energy and effectively increases the sweet spot areas of the racquet significantly.

Other objects, features and advantages of the present invention will be readily appreciated as the same becomes better understood after reading the subsequent description when considered in connection with the accompanying drawings.

BRIEF DESCRIPTION OF THE DRAWINGS

FIG. 1 is a perspective view of a stringed racquet including a vibration damping device, according to the present invention.

FIG. 2 is a partial front view of the stringed racquet and the vibration damping device of FIG. 1.

FIG. 3 is an exploded view of the vibration damping device of FIGS. 1 and 2.

FIG. 4 is a perspective view of the vibration damping device of FIGS. 1 and 2.

FIG. 5 is a graph comparing relative frequency responses at handle between an undamped stringed racquet and a damped stringed racquet employing the vibration damping device according to the present invention.

DESCRIPTION OF THE PREFERRED EMBODIMENT(S)

Figure 6:
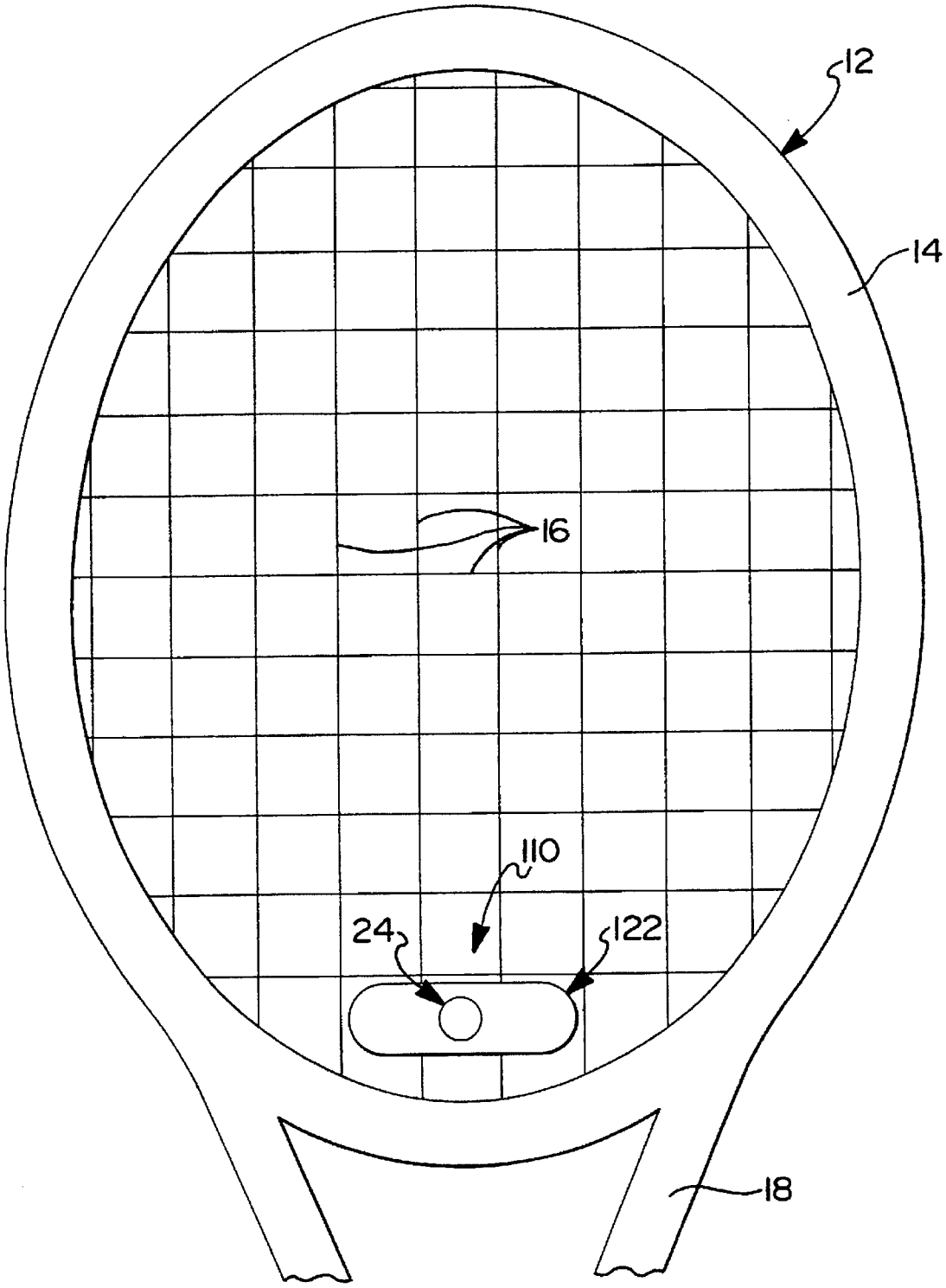
FIG. 6 is partial front view of a stringed racquet including another vibration damping device, according to the present invention.

Referring to the drawings and in particular FIG. 1, one embodiment of a vibration damping device 10, according to the present invention, is shown for stringed racquets such as a tennis racquet, generally indicated at 12. The vibration damping device 10 may be employed to reduce vibrations in any stringed racquet but is particularly adapted for use with tennis or racquetball racquets. While the vibration damping device 10 is shown in connection with a tennis racquet 12, it should be appreciated that this is by way of illustration and not by way of limitation. Such racquets 12 generally include a racquet frame 13 having a head 14, strings 16, a throat 18 and a handle 20 as is known in the art.

Referring to FIGS. 1 through 4, the vibration damping device 10 includes a viscoelastic member, generally indicated at 22, which is adapted to be mounted between the strings 16 of the racquet 10. The viscoelastic member 22 is ideally mounted low on a face of the racquet 12 near the throat 18. However, it should be appreciated that the vibration damping device 10 may be mounted at any position on the face of the racquet 12 which would not otherwise interfere with play.

The vibration damping device 10 also includes at least one movable mass or member, generally indicated at 24, carried on the viscoelastic member 22. The movable member 24 is movable relative to the viscoelastic member 22 in response to vibrations induced by an impact on the strings 16 of the racquet 12 such that the vibration damping device 10 vibrates over the same frequency range but out of phase with the racquet 12 to dampen vibrations in the racquet 12. More specifically, and in one embodiment, the vibration damping device 10 vibrates at the same frequencies as the racquet 12 but one hundred eighty degrees (180°) out of phase with the racquet 12.

The viscoelastic member 22 includes a body 26 which is made of a viscoelastic material with appropriate modulus and damping values. The body 26 has a pair of opposed flat sides 28 and a pair of slots 30 disposed opposite one another on the body 26 and interposed between the flat sides 28. The pair of slots 30 are adapted to receive a pair of the strings 16 on the racquet 12 to mount the vibration damping device 10 thereto. The body 26 includes at least one aperture 32 extending through the body 26 between and substantially perpendicular to the opposed flat sides 28. It should be appreciated that the body 26 may have any suitable shape such as rectangular, circular, oval, diamond or star.

The movable member 24 extends through the aperture 32 and on either side of the body 26 of the viscoelastic member 22. More specifically, and in one embodiment, the body 26 includes a pair of apertures 32 spaced relative to one another and extending between the pair of opposed flat sides 28. In one embodiment, the vibration damping device 10 includes a pair of movable members 24. Each movable member 24 is a weight made of metal including a pair of enlarged head portions 34 and a connecting portion 36 extending between the head portion 34 and through each of the apertures 32. The weight 24 is movable relative to the body 26 in the apertures 32 in a direction perpendicular to the face of the racquet 12. Each of the enlarged heads 34 on the movable members 24 are disposed adjacent to the pair of opposed flat sides 28 of the body 26. It should be appreciated that the enlarged head portions 34 of the movable members 24 are pushed through the apertures 32 such that the connecting portion 36 extends through the apertures 32 in the body 26 and the enlarged head portions 34 of the movable members 24 are disposed on both sides of the body 26.

The pair of slots 30 extend perpendicular to and intersect with the pair of apertures 32 such that the strings 16 of the racquet 12 are located between the pair of movable members 24 in the opposed slots 30 when the vibration damping device 10 is mounted to the racquet 12 as shown in FIGS. 1 and 2.

The vibration damping device 10, according to the present invention, functions as a tuned vibration absorber which acts instantaneously as the impact of the ball is being imparted to the racquet 12. The vibration damping device 10 vibrates at the same frequency as the fundamental bending mode of the racquet frame 13 and in a phase opposite to the frame vibration. The vibration of the vibration damping device 10 in opposite phase helps in canceling the vibration of the racquet frame 13. Thus, the vibration damping device 10 of the present invention effectively reduces the unwanted, excessive energy transmitted to the holder of the racquets.

Referring to FIG. 5, the time responses in the frequency between an undamped tennis racquet and a damped tennis racquet are compared. The peak amplitude of the frequency on the damped system is reduced into two smaller amplitude levels. As the peak amplitude is reduced by almost a factor of 10, the time required to damp out the vibrations will proportionally be reduced. The absorption of excessive energy levels results in a reduction in the energy absorbed by the human body and thus reduces pain and tiredness in the holder's arm.

The vibration damping device 10 of the present invention is tuned to the fundamental bending mode frequency of any racquet by (1) varying the distance between the center of the mass and the string to which the vibration damping device 10 is attached and/or (2) varying the mass, and/or (3) varying the stiffness properties of the viscoelastic member, and/or (4) the cross section of the body 26 of the viscoelastic member 22. Thus, the vibration damping device 10 of the present invention acts as a cantilever beam cantilevered at the strings 16. The equations governing the frequency of a cantilever beam are as follows:

The stiffness for a transverse vibration is given by $$k = 3\frac{EI}{\beta}$$

where E is the modulous of elasticity, l is the length of the body 26 and I is the moment of inertia defined as:

$$\frac{bh^3}{12}$$

and is dependent upon the height and thickness of the body of the viscoelastic member 22.

The equivalent mass of the system is defined as $$M_{eq}=M_{sprung}+0.23m_{rubber}$$

The frequency of this system is defined as $$\frac{1}{2\pi}\sqrt{\frac{k}{M_{eq}}}$$

By varying E, l, b, h and M the required frequency can be obtained for the vibration damping device 10 of the present invention. For example, the total weight of the movable member 24 ranges from 2.1 grams to 3.2 grams, the height and thickness of the body 26 may be 0.25 and 0.4 inches, respectfully, and the length of the body 26 ranges from 0.95 to 1.45 inches. As a result, the vibration damping device 10 has a frequency range, for example, of approximately 125 Hz to 210 Hz.

Referring to FIG. 6, another vibration damping device 110 is shown for the tennis racquet 12. Like parts of the vibration damping device 10 have like reference numerals increased by one hundred (100). The vibration damping device 110 has a single moveable member 24 and is mounted to the strings 16 such that the moveable member 24 is suspended between the strings 16. This type of vibration damping device 110 acts as a fixed-fixed beam whose stiffness (k) is sixteen (16) times the stiffness of a cantilever beam and is given by:

$$k = 48\frac{EI}{l^3}$$

and the equivalent mass of the system is defined by:

$$Meq=M_{sprung}+0.5m_{rubber}$$

The equation for the frequency of the system is as above discribed.

Alternatively, the body of the viscoelastic member 122 may be a thin slice of rubber being wrapped around the strings with the movable member 124 in the center. The body has a center hole for the movable member 124 with an end hole spaced on each side which is folded over a string 16 with the moveable member 124 passing through each end hole to hold the body on the moveable member 124. This will act as a tuned damper and effectively cancel the vibrations.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A vibration damping device for stringed racquets comprising:

a viscoelastic member adapted to be mounted between at least two parallel strings of a stringed racquet; and at least one movable member having at least two enlarged portions and a connecting portion extending between said at least two enlarged portions and through said viscoelastic member and moveable relative to said viscoelastic member in response to vibrations of the stringed racquet induced by an impact of an object on the strings of the stringed racquet such that said vibration damping device vibrates over the same frequency range but out of phase with the stringed racquet to damp vibrations in the stringed racquet.

2. A vibration damping device as set forth in claim 1 wherein said viscoelastic member has a body including at least one aperture extending through said body, said at least one movable member extending through said at least one aperture and on either side of said body of said viscoelastic member.

3. A vibration damping device as set forth in claim 2 wherein said at least one movable member is a weight including a pair of enlarged head portions and a connecting portion extending between said head portions and through said at least one aperture, said weight being movable relative to said body in said at least one aperture in a direction perpendicular to the face of the racquet.

4. A vibration damping device as set forth in claim 2 wherein said body has a pair of opposed flat sides.

5. A vibration damping device as set forth in claim 2 wherein said body includes a pair of apertures spaced relative to one another and extending between said pair of opposed flat sides.

6. A vibration damping device as set forth in claim 5 wherein said vibration damping device includes a pair of movable members each having a pair of enlarged head portions and a connecting portion extending between said head portions and through a respective one of said pair of apertures.

7. A vibration damping device as set forth in claim 2 wherein said body includes a pair of slots disposed opposite one another on said body, said pair of slots adapted to receive a pair of strings on the stringed racquet to mount said vibration damping device thereto.

8. A vibration damping device as set forth in claim 7 wherein said pair of slots extend perpendicular to and intersect with a pair of apertures such that the strings of the stringed racquet are located between a pair of movable members in said opposed slots when said vibration damping device is mounted to a stringed racquet.

9. A vibration damping device as set forth in claim 1 wherein said movable member is made of metal.

10. A vibration damping device for stringed racquets comprising:

a viscoelastic member having a body including at least one aperture extending through said body adapted to be mounted between at least two parallel strings of a stringed racquet; and at least one movable member having a pair of enlarged head portions and a connecting portion extending between said head portions and through said at least one aperture and on either side of said body of said viscoelastic member and moveable relative to said viscoelastic member in response to vibrations of the stringed racquet induced by an impact of an object on the strings of the stringed racquet such that said vibration damping device vibrates over the same frequency range but out of phase with the stringed racquet to damp vibrations in the stringed racquet.

11. A vibration damping device as set forth in claim 10 wherein said body includes a pair of apertures spaced relative to one another and a pair of movable members each having a pair of enlarged head portions and a connecting portion extending between said head portions and through a respective one of said pair of apertures.

12. A vibration damping device as set forth in claim 10 wherein said body has a pair of opposed flat sides.

13. A vibration damping device as set forth in claim 10 wherein said body includes a pair of slots disposed opposite one another on said body, said pair of slots adapted to receive a pair of strings on the stringed racquet to mount said vibration damping device thereto.

14. A vibration damping device as set forth in claim 13 wherein said pair of slots extend perpendicular to and intersect with a pair of apertures such that the strings of the stringed racquet are located between said pair of movable members in said opposed slots when said vibration damping device is mounted to a stringed racquet.

15. A vibration damping device as set forth in claim 10 wherein said moveable member is made of a metal and has a dumbbell shape.

16. A vibration damping device for stringed racquets comprising:

a viscoelastic member having a body including at least one aperture extending through said body adapted to be mounted between at least two parallel strings of a stringed racquet;

at least one movable weight member extending through said at least one aperture and on either side of said body of said viscoelastic member and moveable relative to said viscoelastic member in response to vibrations of the stringed racquet induced by an impact of an object on the strings of the stringed racquet such that said vibration damping device vibrates over the same frequency range but out of phase with the stringed racquet to damp vibrations in the stringed racquet;

said at least one movable weight member having a pair of enlarged head portions and a connecting portion extending between said head portions and through said at least one aperture, said at least one movable weight member being movable relative to said body in response to vibrations of the stringed racquet induced by an impact of an object on the strings of the stringed racquet in said at least one aperture in a direction perpendicular to the strings of the stringed racquet; and said body having a pair of opposed flat sides, said pair of enlarged head portions being disposed adjacent to said pair of opposed flat sides of said body.

17. A vibration damping device for stringed racquets comprising;

a viscoelastic member adapted to be mounted between at least two parallel strings of a stringed racquet; and means for extending through said viscoelastic member and for moving relative to said viscoelastic member in response to vibrations of the stringed racquet induced by an impact of an object on the strings of the stringed racquet such that said vibration damping device vibrates over the same frequency range but out of phase with the stringed racquet to damp vibrations in the stringed racquet.

* * * * *

UNITED STATES PATENT AND TRADEMARK OFFICE

CERTIFICATE OF CORRECTION

PATENT NO. : 5,651,545

DATED : July 29, 1997

INVENTOR(S) : Ahid D. Nashif et al.

It is certified that error appears in the above-identified patent and that said Letters Patent is hereby corrected as shown below: On the title page: Item [57]

Column 1, Under "References Cited - U.S. Patent Documents", "2/1855" should be -- 6/1912--.

Column 4, line 30, after "body" insert --26--.

Signed and Sealed this

Ninth Day of December, 1997

*Attest:*

*Attesting Officer*

BRUCE LEHMAN

*Commissioner of Patents and Trademarks*